United States Patent [19]

Garabedian

[11] Patent Number: 4,919,481

[45] Date of Patent: Apr. 24, 1990

[54] MULTIPLE POSITIONABLE CHAIR CONSTRUCTION

[76] Inventor: Edward A. Garabedian, 4151 Arch Dr., #311, Studio City, Calif. 91604

[21] Appl. No.: 292,997

[22] Filed: Jan. 3, 1989

[51] Int. Cl.[5] ..... A47C 3/02

[52] U.S. Cl. ..... 297/258; D6/348

[58] Field of Search ..... 297/131, 258, 441; D6/344, 348; 272/28 R, 33 A

[56] References Cited

U.S. PATENT DOCUMENTS

| | | | |
|---|---|---|---|
| D. 168,270 | 11/1952 | Lamb | D6/348 |
| 2,482,306 | 9/1949 | Waldheim | 297/270 |
| 3,072,435 | 1/1963 | Komulainen | 297/258 |
| 3,526,429 | 9/1970 | Netzger | 297/258 |
| 4,159,146 | 6/1979 | Braconnier et al. | 297/258 |

FOREIGN PATENT DOCUMENTS

| | | | |
|---|---|---|---|
| 709453 | 5/1931 | France | 297/258 |
| 2067892 | 8/1981 | United Kingdom | 297/258 |

*Primary Examiner*—James T. McCall

*Attorney, Agent, or Firm*—George J. Netter

[57] ABSTRACT

A chair has a pair of rodlike supports for contacting the ground, each of which have a first portion under the legs and seat which is curved to a first radius, and a second portion curved to a second radius different from said first radius. A flexible cover is mounted onto cross braces between the rodlike supports with the cover central portion being left hanging.

6 Claims, 3 Drawing Sheets

MULTIPLE POSITIONABLE CHAIR CONSTRUCTION

The present invention relates generally to a chair construction, and, more particularly, to such a chair construction which has an extended range of continuously adjustable fixed tilt positions while also enabling the chair to be used as a rocker, and having exceptional resistance against inadvertent overturning during use.

SUMMARY OF THE DISCLOSURE

In the practice of the present invention there is provided a chair construction including first and second rodlike support elements which are identically formed to have one part curved to a first radius and another part curved to a second radius. Two rodlike side members are identically formed at substantially their midpoints dividing them into an upper part corresponding to a backrest and a lower part corresponding to the region for the chair seat and leg rest. The side members are further bent to define a demarcation point between the seat and leg rest regions.

The side members are each secured (e.g., welded) to the support elements at three points, namely, the two ends and at the frame points dividing the backrest from the remainder. Each side member and the support element to which it is secured forms a side frame.

Four individual cross braces of equal length interconnect and hold the side frames spaced apart at the two ends and at the point separating the seat and backrest. One further cross brace interconnects the frame at the junction of the seat and leg rest portion.

A sheet loop of flexible material is affixed to the two cross braces at the chair top and at the bottom, and is allowed to float so that when an individual sits down on the chair it will mold to the body and the individual will not have his body weight resting on the underlying cross braces.

In use, the individual places his weight on the flexible material loop in the normal manner. Depending upon how the individual shifts his center of gravity a continuous adjustment of the support elements ground contact can be achieved throughout substantially their full length so that the individual can assume and maintain an orientation throughout a corresponding angular range with respect to the floor's surface. Upon once assuming that position, as long as there is no movement or intentional shifting of the body weight either forward or backward, the chair will maintain that selected orientation.

By virtue of having the shorter radius curved support elements on the upper part of the chair above the seat, the chair on rocking to an extreme backward angle is first of all slowed down reducing the tendency for an inadvertent overturn from surprise, and then allows a stable orientation even if the individual has his back substantially parallel to the ground. In addition, since the actual part of the seat contacting the body is flexible material on orienting the chair to an extreme position with the back approaching parallel to the ground plane, the flexible material will give causing the body's center of gravity to shift forward reducing even further any tendency to overturn.

DESCRIPTION OF THE DRAWING

FIG. 9 is an exploded view of the various parts of the chair of FIG. 2.

DESCRIPTION OF A PREFERRED EMBODIMENT

Figure 1:
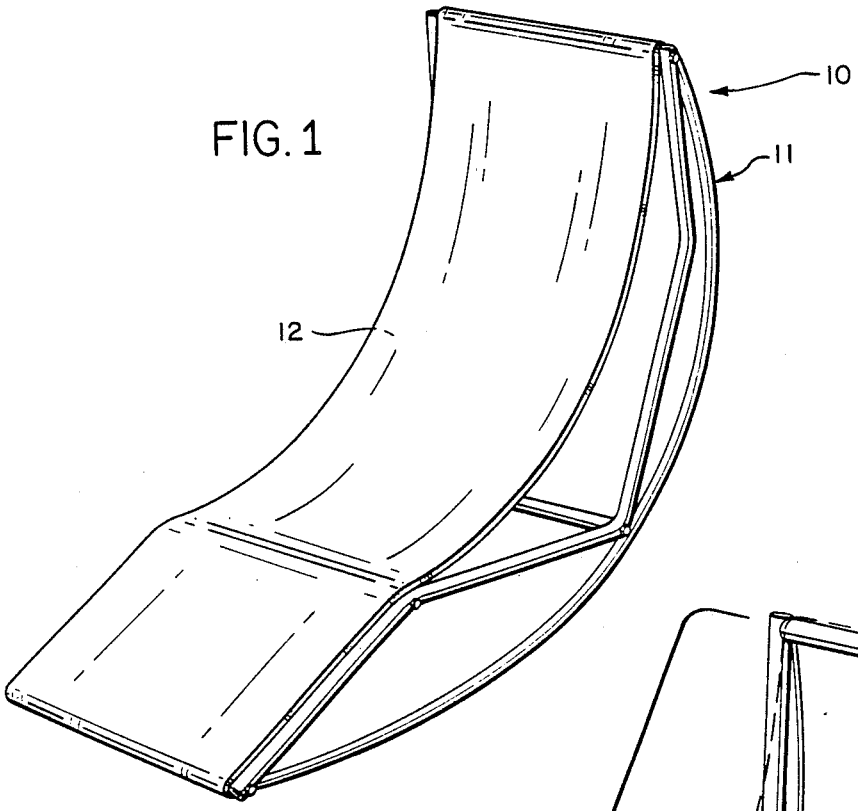
FIG. 1 is a perspective view of the chair of the present invention.
Figure 2:
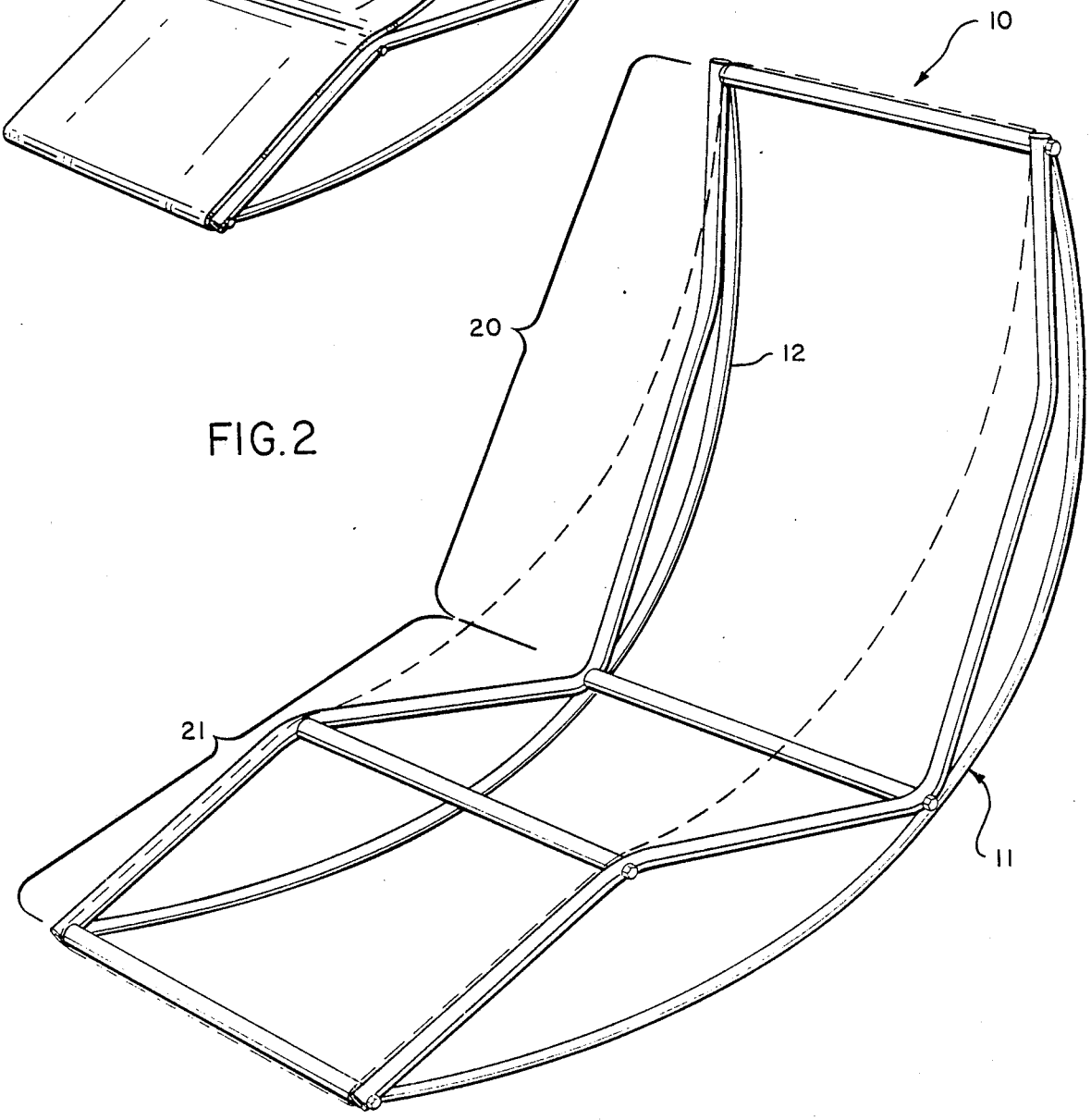
FIG. 2 further perspective view of the chair frame depicted with the flexible seat cover removed.
Figure 3:
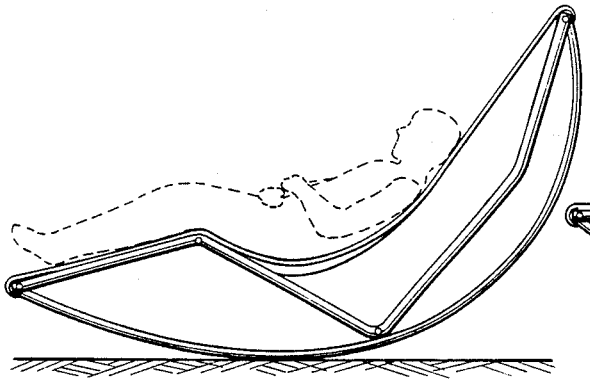
FIGS. 3 through 7 show in schematic form the various angular positions which can be stably attained in use of the described chair.
Figure 4:
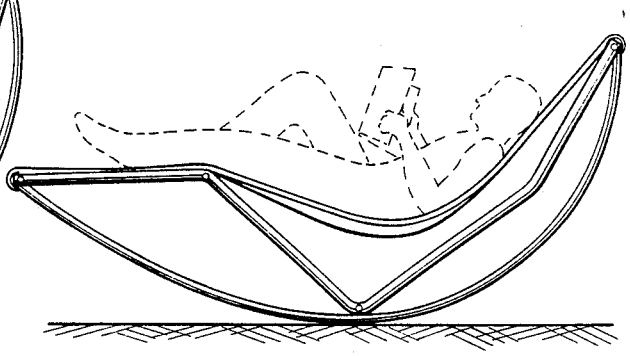

Turning now to the drawings and particularly FIGS. 1 and 2, the chair of the present invention identified generally as 10 is seen to include curved rodlike support elements 11 and 12 which are assembled to one another in a unitary framework and function to enable resting at any particular selected angular relation to the ground plane and to allow for rocking back and forth as desired in between any of the various stable resting positions. The outer seating surface on which the individual sits consists of a loose, flexible fabric cover 13 having one end secured at a top edge of the chair and the opposite end secured to the lower or foot end of the chair. When the individual sits in the chair, the flexible cover 13 conforms to the body providing a relaxing and comfortable contact to the user. The flexible covering also transmits the forces developed by the individual sitting on the chair to the framework and acts, in a way that will be more specifically described, to transmit forces to the frame for angularly reorienting the chair to a new fixed position, or for rocking, if desired, as well as enhancing stability.

For the ensuing detailed description, reference is now made simultaneously to FIGS. 2 and 9. More particularly, the entire chair framework 14 includes two side frames 15 and 16 preferably identical in construction, and which side frames are interconnected by a plurality of links or braces to be described holding the side frames spaced apart and in a unitary relation.

Since the side frames are preferably identical, only side frame 15 will be described in detail, it being understood that frame 16 is similarly constructed. Specifically, side frame 15 includes a single compound curved support element 11 formed from a solid metal rod, or, optionally, the rod may be hollow. A first curved portion 20 that is substantially one-half of the support element length and contemplated for location under the backrest part of the chair is preferably formed into a radius of approximately 30 inches. The second or remaining half 21 is formed into a second radius which is substantially greater than the radius of portion 20 and preferably about 71 inches. The two curves of each support lie in the same plane. The operation and effect of the support element two curves will be described later.

An elongated metal tubular side member 22 is bent at 23 which defines generally the dividing point between the backrest portion and the remaining part serving as a seat and legrest. A second bend 24 directed oppositely to 23 is located approximately where the knees of a user would be located. Another bend 25 in the same direction as bend 23 only of a greater angle is situated at about shoulder height for user of the chair.

The side member 22 is secured to the support element 11 at both ends and at the side opposite bend 23 preferably by welding. The member 22 and support element to which it is secured define a single flat plane.

Accordingly, each side frame 15 and 16 includes unitary arrangement of a support element 11 or 12, as the case may be, and a side member 22. For assembly, the two side frames are secured together by four equilength rodlike links or braces 17: one at the top ends of members 22, a second interconnecting bends 23, a third between the two side member bends 24, and the fourth at the member lower end. Securement of the rods to the frames is preferably accomplished by rivets 26 which pass through openings in members 22 and are force fit into openings in the ends of rods 17. Optionally, instead of rivets, bolts may be threaded into the rod ends.

As an additional and intermediate step in assembly, the flexible sheet material 13 which may be formed into a closed loop is fitted onto braces 17 at both ends of the chair. The dimensions of 13 are such that it hangs freely and when someone sits on the fabric there is no pressure contact with the two centrally located underlying braces 17 defining the seat.

For the following discussion of use of the described chair, reference is made to FIGS. 3–7 showing various angular orientations of the chair which can be stably maintained, as well as all positions in between. As a result of a continuous curve being given to the full length of support elements 11 having first and second parts of substantially different radii of curvature, the chair is exceptionally stable and very difficult to tip over. By providing the portion 20 with the described curvature, on rocking the chair backward so that curved portion 21 no longer is in contact with the ground plane, further backward movement is automatically slowed by the change in curvature which prevents inadvertent sudden overturning backwardly that is possible in conventional rockers. Also, it is to be noted that since the seat cover 13 is flexible it conforms closely to the body and when the chair is tipped backward an extreme amount the user's body actually curls forwardly somewhat making backward upset of the chair even less likely.

Moreover, since the support elements 11 and 12 present a continuously curved contact with the ground plane extending from a point behind the user's head (or, actually, slightly beyond the head for many people) to the feet or slightly beyond, shifting of the weight enables positioning the chair at any selected angular position throughout a wide angular range (FIGS. 3–7). Stability is possible throughout the extreme range of angular tip because the center of gravity (C.G.) of the individual remains over the base of the chair in each position.

Figure 5:
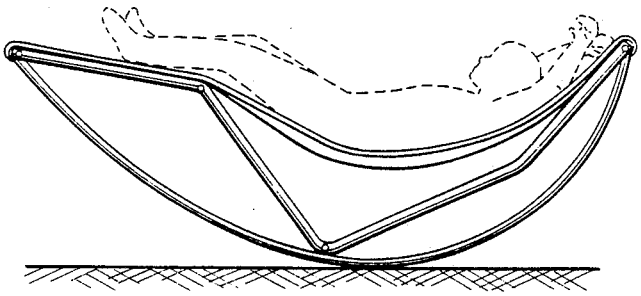
Figure 6:
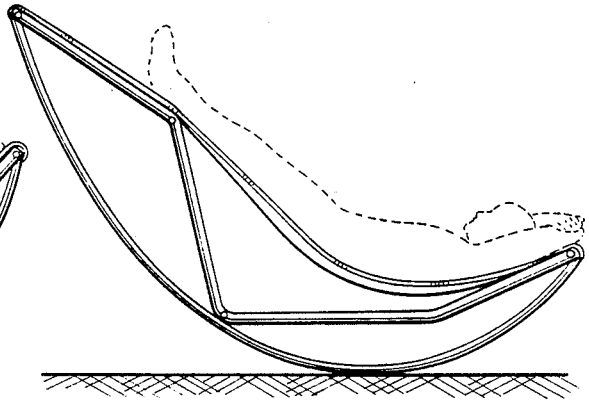
Figure 7:
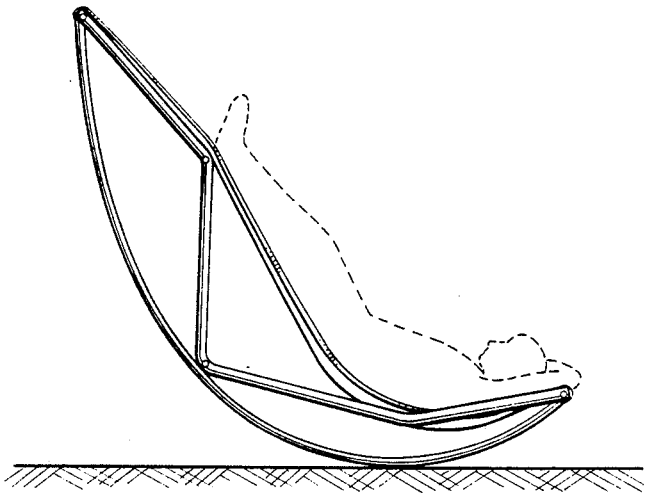
Figure 8:
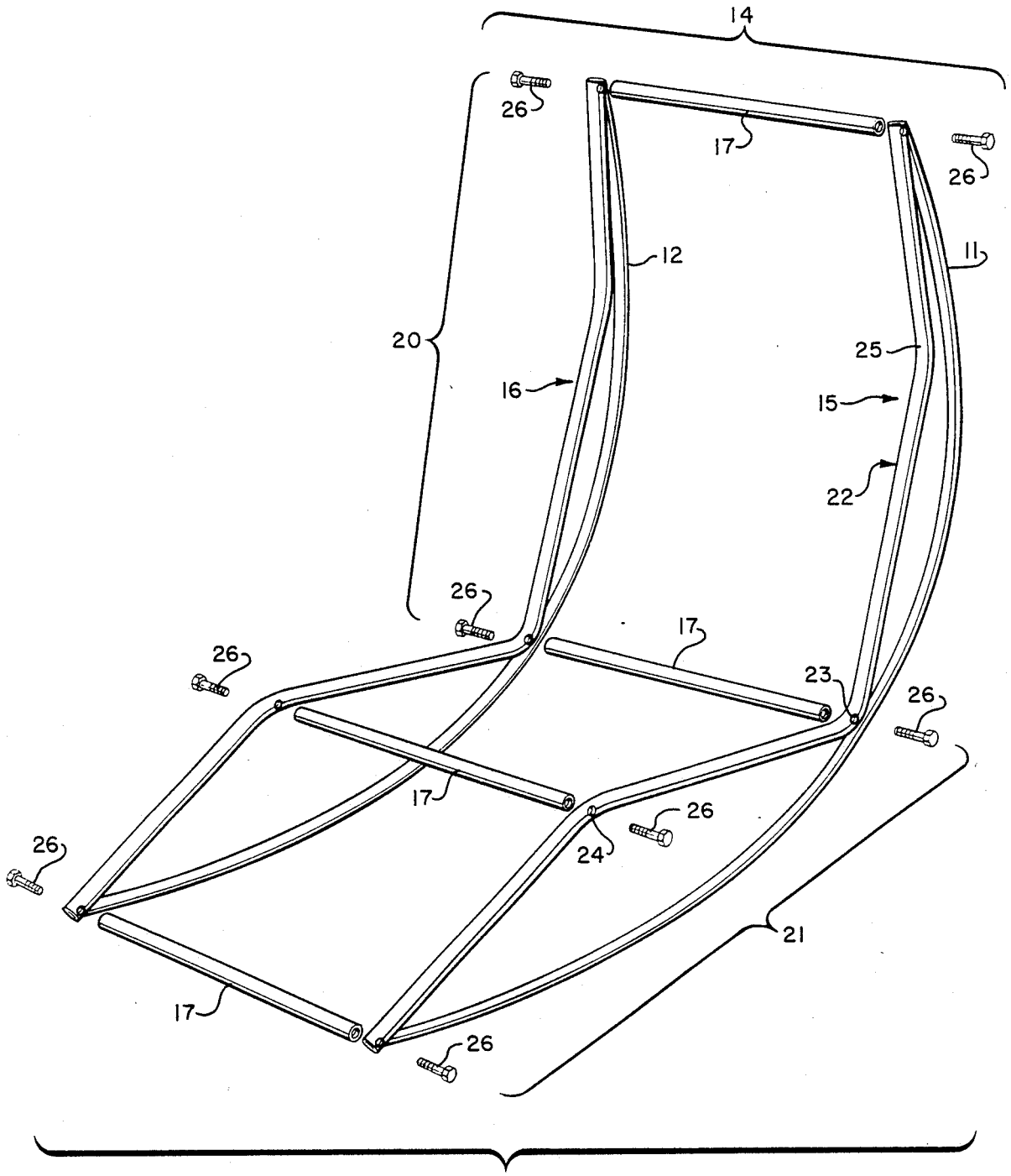

A practical construction of the described invention was found to operate satisfactorily for individuals ranging from 5.0 feet to 6.0 feet in height. The dimensions shown in FIG. 5 represent actual dimensions of a chair having the support elements curved to a 71 inch radius in one portion and a 30 inch radius in another, as already described.

For proper operation of the chair of this invention it is important that someone using the chair not brace either his feet or head against a cross brace 17, but instead have both the head and feet resting entirely on the cover. In fact, the entire body should be carried by the flexible sheet material cover 13 with no body pressure directly applied to the cross braces other than through the instrumentality of the flexible cover. This is achieved, first of all, by the overall length of the chair (i.e., 80 inches) being more than enough to handle the average height of chair users. Secondly, the flexible material cover must be so dimensioned that when it is mounted onto the upper and lower chair cross-braces it will be in bearing contact with the other cross braces during use.

Although the described chair can be manufactured and sold fully assembled, it is contemplated that it would be preferable to package the chair parts in a kit for assembly by the purchaser. In that case, each kit would include side frames 15 and 16, four braces 17, a flexible cover, and rivets or bolts for securing the side frames and braces together. Moreover, although in a practical construction of the invention carbon steel rectangular tubing was used, it is contemplated that other metals or plastics may be used of, say, circular cross-section, for example, and still be within the spirit of the invention.

I claim:

1. A chair construction, comprising:

first and second side frames, each including, a continuously curved support element having one concave portion and one convex portion, the convex side being adapted for contacting a ground plane, a tubular side member arranged within a support element concave portion having its ends and a central point secured to the said support element, each tubular side member having a first bend at the central point secured to a support element, a second bend above the first bend approximately at shoulder height for a seated chair user, and a third bend substantially behind the knees of a seated chair user;

a plurality of equilength rodlike braces each having its two ends respectively secured to the first and second side frames forming a unitary framework; and a flexible sheet of material having opposite end portions connected to two of the braces leaving the central part thereof unsupported providing a seating surface.

2. A chain construction comprising:

first and second side frames, each including, a continuously curved support element having one concave portion and one convex portion, the convex side being adapted for contacting a ground plane, each said support element having a first portion with a first radius of curvature of approximately 71 inches and the remainder of the said support element having a second radius of curvature of approximately 30 inches, a tubular side member arranged within a support element concave portion having its ends and a central point secured to the said support element;

a plurality of equilength rodlike braces each having its two ends respectively secured to the first and second side frames forming a unitary framework; and a flexible sheet of material having opposite end portions connected to two of the braces leaving the central part thereof unsupported providing a seating surface.

3. A chain construction, comprising:

first and second side frames, each including a continuously curved support element having one concave portion and one convex portion, the convex side being adapted for contacting a ground plane, a tubular side member arranged within a support element concave portion having its ends and a central point secured to the said support element;

a plurality of equilength rodlike braces each having its two ends respectively secured to the fist and second side frames forming a unitary framework; and a closed loop flexible sheet of material having opposite end portions connected to two of the braces leaving the central part thereof unsupported providing a seating surface.

4. A chain construction as in claim 1, in which the rodlike braces respectively interconnect the side frames adjacent each end and at the first bend of each side member.

5. A chair construction as in claim 2, in which the tubular side members are secured to the curved support elements by welding.

6. A claim construction as in claim 2, in which the first radius portion contacts the ground when no one is in the chair and the second radius portion extends backwardly and upwardly from the first radius portion.

* * * * *

UNITED STATES PATENT AND TRADEMARK OFFICE

CERTIFICATE OF CORRECTION

PATENT NO. : 4,919,481

DATED : April 24, 1990

INVENTOR(S) : Edward A. Garabedian

It is certified that error appears in the above—identified patent and that said Letters Patent is hereby corrected as shown below:

Column 2, line 6, "9" should be --8--.

Column 4, line 38, "chain" should be --chair--.

Column 4, line 59, "chain" should be --chair--.

Column 5, line 9, "chain" should be --chair--.

Column 6, line 6, "claim" (first occurrence) should be --chair--.

Signed and Sealed this

Twenty-eighth Day of May, 1991

*Attest:*

*Attesting Officer*

HARRY F. MANBECK, JR.

*Commissioner of Patents and Trademarks*